US011830463B1

(12) United States Patent
Kurek et al.

(10) Patent No.: US 11,830,463 B1
(45) Date of Patent: Nov. 28, 2023

(54) AUTOMATED ORIGINAL TRACK GENERATION ENGINE

(71) Applicant: Library X Music Inc., South Pasadena, CA (US)

(72) Inventors: Maciej Kurek, Warsaw (PL); Antony Demekhin, Los Angeles, CA (US); Filip Mitrovic, Los Angeles, CA (US)

(73) Assignee: Library X Music Inc., South Pasadena, CA (US)

( * ) Notice: Subject to any disclaimer, the term of this patent is extended or adjusted under 35 U.S.C. 154(b) by 0 days.

(21) Appl. No.: 18/204,409

(22) Filed: Jun. 1, 2023

Related U.S. Application Data

(60) Provisional application No. 63/347,613, filed on Jun. 1, 2022.

(51) Int. Cl.
*G10H 1/00* (2006.01)

(52) U.S. Cl.
CPC ..... *G10H 1/0025* (2013.01); *G10H 2210/111* (2013.01); *G10H 2250/311* (2013.01)

(58) Field of Classification Search
CPC ..... G10H 1/0025; G10H 2210/111; G10H 2250/311
See application file for complete search history.

(56) References Cited

U.S. PATENT DOCUMENTS

| | | | | |
|---|---|---|---|---|
| 2008/0257133 | A1 | 10/2008 | Sasaki et al. | |
| 2017/0060520 | A1* | 3/2017 | Cohen | H04L 67/01 |
| 2017/0092247 | A1* | 3/2017 | Silverstein | G10H 1/0025 |
| 2020/0089705 | A1* | 3/2020 | Roswell | G06F 3/0482 |
| 2020/0090632 | A1* | 3/2020 | Rein | G06N 20/00 |
| 2020/0103980 | A1 | 4/2020 | Katz et al. | |
| 2022/0114993 | A1 | 4/2022 | Nordin et al. | |
| 2022/0406283 | A1* | 12/2022 | Kishi | G10H 1/0025 |

* cited by examiner

*Primary Examiner* — Jianchun Qin
(74) *Attorney, Agent, or Firm* — Georgiy L. Khayet

(57) ABSTRACT

Systems and methods for automated music generation are provided. An example method includes receiving, from a user, a user input including at least one of configuration settings and a musical audio input in the form of audio files or an audio recording; selecting, based on the user input and from a plurality of predetermined musical development scenarios, a musical development scenario including a chronologically ordered sequence of set settings; selecting, based on the musical development scenario, from a plurality of event probability scenarios, an event probability scenario defining a probability of a music element creation event; selecting a plurality of sets of audio elements from a plurality of pre-composed audio elements based on the musical development scenario, the user input, the event probability scenario, and predetermined music theory rules; and synthesizing the plurality of sets of audio elements to generate an audio output for providing to the user.

18 Claims, 4 Drawing Sheets

AUTOMATED ORIGINAL TRACK GENERATION ENGINE

CROSS-REFERENCE TO RELATED APPLICATIONS

The present application claims priority of U.S. Provisional Patent Application No. 63/347,613 filed on Jun. 1, 2022, entitled "AUTOMATED ORIGINAL TRACK GENERATION ENGINE." The subject matter of aforementioned application is incorporated herein by reference in its entirety for all purposes.

TECHNICAL FIELD

The present disclosure relates generally to data processing, and, more specifically, to automation of original music production.

BACKGROUND

As video continues to dominate the Internet, with estimates that video will represent over 80% of all Internet traffic by 2024, the demand for affordable and legal music options for video continues to grow as well. However, most video producers, from amateur YouTube® accounts to television producers, are focused on lower budget formats, like reality television, and have few affordable options at their disposal. Specifically, record labels maintain high licensing fee thresholds for popular music, and hiring composers to create bespoke film scores is also very expensive. That leaves many film and video creators on smaller budgets with only one option, specifically, royalty-free music libraries or royalty-managed stock music libraries. In both cases, these libraries are high-volume, low-cost, and low-quality options. Users are forced to search through deep catalogs of music hoping to find something that sounds decent and matches the creative requirements of their project. Without much disruption or innovation in the stock music space, the sector continues to grow 9% year over year thanks to increased demand from video producers and lack of alternative options.

Producing music utilizing digital audio workstation software remains highly technical and out of reach for most hobbyists working with music, including musicians who play an instrument, singers, and other vocalists. While the number of music creators who produce music and upload it to streaming services is in the tens of millions, it is estimated that over 500 million people globally play an instrument or have some form of musical training. Music production and recording software remains out of reach for most musicians and singers, even as more accessible music creation apps become available for casual music makers.

The field of artificial intelligence (AI) generated, algorithmic, and automated music production is still in its early days. Several academic and early commercial projects in the field have so far produced scalable but low quality and somewhat soulless music results when completely unsupervised or unedited by a human. Some companies have produced "AI music," but in most cases the best examples of this conventional technology still require a human touch to make the music sound good.

Most current "AI music" projects and companies use a fully generative model. A neural network learns according to one of two common approaches. According to the first approach, a neural network learns certain musical rules and patterns from a dataset of pre-existing musical compositions in Musical Instrument Digital Interface (MIDI) format and "learns" how to generate its own original melodies, chord progressions, basslines, drum patterns, and rhythms using the MIDI format. The technology then synthesizes this MIDI data into audio using software instrument synthesis. The limitation of this approach in achieving a quality end result that sounds "good" and "emotionally relatable" to a human listener is two-fold.

First, the melodies and chords which typically affect human emotions are created by an algorithm with no ability to validate their emotional impact. Second, these melodic ideas are then expressed as audio music utilizing software synthesis which lacks the expressiveness and emotional performance of a human playing an instrument by themselves or with other musicians. In the second approach, a neural network learns from a dataset of labeled audio features, which are often represented as spectrograms. These features are used to generate new audio samples, which are then transformed back into raw audio format. However, this approach often struggles to produce high-quality, emotionally resonant output, due to the randomness in the selection of melody and chords. Moreover, the process of converting audio into feature representations and back can introduce noise, which degrades the quality of the final output. A significant limitation of this approach is that it requires training on large datasets of copyrighted musical works, which can restrict commercial use of the system's output and potentially raise issues of copyright infringement.

SUMMARY

This section is provided to introduce a selection of concepts in a simplified form that are further described below in the Detailed Description section. This summary is not intended to identify key features or essential features of the claimed subject matter, nor is it intended to be used as an aid in determining the scope of the claimed subject matter.

According to one example embodiment of the present disclosure, a system for automated music generation is provided. The system may include an automated music generation engine and a memory unit in communication with the automated music generation engine. The automated music generation engine may be configured to receive, from a user, a user input. The user input may include at least one of configuration settings and a melodic audio input. Based on the configuration settings or the melodic audio input, the automated music generation engine may select a musical development scenario from a plurality of predetermined musical development scenarios. The musical development scenario may include a chronologically ordered sequence of set settings. Based on the musical development scenario, the automated music generation engine may select, from a plurality of event probability scenarios, an event probability scenario defining a probability of a music element creation event. The automated music generation engine may further select a plurality of sets of audio elements from a plurality of pre-composed audio elements based on the musical development scenario, the user input, the event probability scenario, and predetermined music theory rules. Upon selecting the plurality of sets of audio elements, the automated music generation engine may synthesize the plurality of sets of audio elements, including audio elements provided by the user as the melodic audio input, to generate an audio output for providing to the user. The memory unit may store at least the plurality of predetermined musical development scenarios, the plurality of event probability scenarios, the plurality of pre-composed audio elements, and the predetermined music theory rules.

According to another embodiment of the present disclosure, a method for automated music generation is provided. The method may include receiving, by an automated music generation engine, a user input that may include at least one of configuration settings and a melodic audio input from a user. The method may proceed with selecting, by the automated music generation engine, based on the configuration settings or the melodic audio input, a musical development scenario from a plurality of predetermined musical development scenarios. The musical development scenario may include a chronologically ordered sequence of set settings. The method may further include selecting, by the automated music generation engine, based on the musical development scenario, from a plurality of event probability scenarios, an event probability scenario defining a probability of a music element creation event. The method may proceed with selecting, by the automated music generation engine, a plurality of sets of audio elements from a plurality of pre-composed audio elements. The plurality of sets of audio elements may be selected based on the musical development scenario, the user input, the event probability scenario, and predetermined music theory rules. The method may proceed with synthesizing, by the automated music generation engine, the plurality of sets of audio elements, which may include audio elements provided in the melodic audio input by the user, to generate an audio output for providing to the user.

According to another example embodiment, provided is a non-transitory computer-readable storage medium having instructions stored thereon, which, when executed by one or more processors, cause the one or more processors to perform steps of the method for automated music generation.

Other example embodiments of the disclosure and aspects will become apparent from the following description taken in conjunction with the following drawings.

BRIEF DESCRIPTION OF DRAWINGS

Exemplary embodiments are illustrated by way of example and not limitation in the figures of the accompanying drawings, in which like references indicate similar elements.

DETAILED DESCRIPTION

Figure 1:
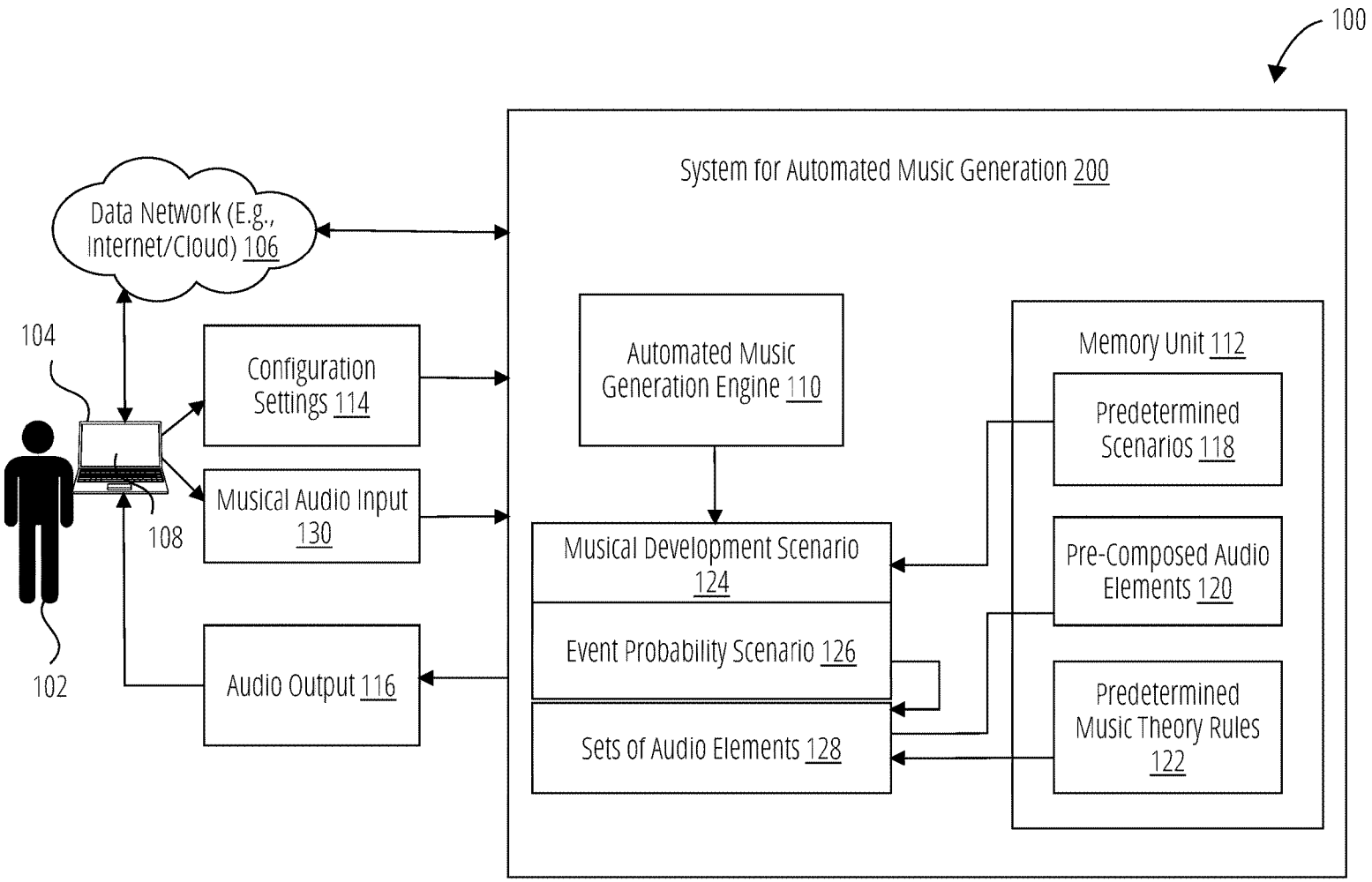
FIG. 1 illustrates an environment within which systems and methods for automated music generation can be implemented, in accordance with some embodiments.

The following detailed description of embodiments includes references to the accompanying drawings, which form a part of the detailed description. Approaches described in this section are not prior art to the claims and are not admitted to be prior art by inclusion in this section. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical, and operational changes can be made without departing from the scope of what is claimed. The following detailed description is, therefore, not to be taken in a limiting sense, and the scope is defined by the appended claims and their equivalents.

Generally, the embodiments of the present disclosure are directed to systems and methods for automated music generation. The systems and methods allow for automation of original music production at scale and address the problems of generating music with emotional performance of a human playing an instrument and validating emotional impact expressiveness of the generated music on a user.

The system may receive a user input from the user. The user input may include configuration settings, such as a desired genre, a desired duration, a desired mood, a narrative arc, and other settings of an audio output desired to be generated by the user. In an example embodiment, the user input may include a melodic audio input in the form of one or more audio files or an audio recording, to be included in a music creation event. Based on the configuration settings and/or the melodic audio input, the system may select a musical development scenario from a plurality of predetermined musical development scenarios. The musical development scenario may include a chronologically ordered sequence of set settings. Based on the selected musical development scenario, the system may select, from a plurality of event probability scenarios, an event probability scenario. The event probability scenario may define a probability of a music creation event taking place during the generation of the audio output.

The system may further select a plurality of sets of audio elements from a plurality of pre-composed audio elements and the melodic audio input received from the user. The pre-composed audio elements may be preliminarily composed by humans and may include a dataset of short, modular audio and MIDI elements. The melodic audio input from the user may be in the form of a completed multi-track song, or a single audio track of an isolated instrument or a vocal recording. The melodic audio input may include modular audio and MIDI elements. The system may select the sets of audio elements based on the selected musical development scenario, the user input, i.e., the configuration settings and/or the melodic audio input, the event probability scenario, and predetermined music theory rules. Upon selection of the sets of audio elements, the system may synthesize the plurality of sets of audio elements to generate an audio output and provide the audio output to the user.

Accordingly, the system uses a unique dataset of short, modular audio and MIDI elements which are created and curated by humans. The system interprets the parameters (i.e., the configuration settings) of a track set by the user across the categories of a genre, mood, narrative arc, tempo, and duration, and then automatically arranges an original track by synthesizing dozens or even hundreds of short audio clips into one cohesive audio track. Accordingly, the system enables the user to provide their own modular audio and MIDI elements to be combined with audio elements already available within the system into one cohesive audio track.

Referring now to the drawings, various embodiments are described in which like reference numerals represent like parts and assemblies throughout the several views. It should be noted that the reference to various embodiments does not limit the scope of the claims attached hereto. Additionally, any examples outlined in this specification are not intended to be limiting and merely set forth some of the many possible embodiments for the appended claims.

FIG. 1 is an environment 100 in which systems and methods for automated music generation can be implemented. The environment 100 may include a user 102, a client device 104 associated with the user 102, a system 200 for automated music generation (also referred herein to as a system 200), and a data network 106 (e.g., an Internet or a cloud). The client device 104 may include a personal computer (PC), a desktop computer, a laptop, a smartphone, a tablet, or so forth. The client device 104 may communicate with the system 200 via the data network 106. In an example embodiment, the client device 104 may have a user interface 108 associated with the system 200. In a further example embodiment, a web browser (not shown) may be running on the client device 104 and displayed using the user interface 108.

The data network 106 may include the Internet or any other network capable of communicating data between devices. Suitable networks may include or interface with any one or more of, for instance, a local intranet, a corporate data network, a data center network, a home data network, a Personal Area Network, a Local Area Network (LAN), a Wide Area Network (WAN), a Metropolitan Area Network, a virtual private network, a Wi-Fi® network, a storage area network, a frame relay connection, an Advanced Intelligent Network connection, a synchronous optical network connection, a digital T1, T3, E1 or E3 line, Digital Data Service connection, Digital Subscriber Line connection, an Ethernet connection, an Integrated Services Digital Network line, a dial-up port such as a V.90, V.34 or V.34bis analog modem connection, a cable modem, an Asynchronous Transfer Mode connection, or a Fiber Distributed Data Interface or Copper Distributed Data Interface connection. Furthermore, communications may also include links to any of a variety of wireless networks, including Wireless Application Protocol, General Packet Radio Service, Global System for Mobile Communication, Code Division Multiple Access or Time Division Multiple Access, cellular phone networks (e.g., a Global System for Mobile (GSM) communications network, a packet switching communications network, a circuit switching communications network), Global Positioning System, cellular digital packet data, Research in Motion, Limited duplex paging network, Bluetooth® radio, or an IEEE 802.11-based radio frequency network, a Frame Relay network, an Internet Protocol (IP) communications network, or any other data communication network utilizing physical layers, link layer capability, or network layers to carry data packets, or any combinations of the above-listed data networks. The data network 106 can further include or interface with any one or more of a Recommended Standard 232 (RS-232) serial connection, an IEEE-1394 (FireWire) connection, a Fiber Channel connection, an IrDA (infrared) port, a Small Computer Systems Interface connection, a Universal Serial Bus (USB) connection or other wired or wireless, digital or analog interface or connection, mesh or Digi® networking. In some embodiments, the data network 106 may include a corporate network, a data center network, a service provider network, a mobile operator network, or any combinations thereof.

The system 200 may include an automated music generation engine 110 and a memory unit 112 in communication with the automated music generation engine 110. In an example embodiment, the automated music generation engine 110 may be configured to receive a user input in form of configuration settings 114 and/or a musical audio input 130 from the user 102. The configuration settings 114 may include at least one of a desired genre, duration, mood, narrative arc, and so forth. The musical audio input 130 may include one or more audio files and an audio recording, such as a completed multi-track song, or a single audio track of an isolated instrument or vocal recording. Based on the configuration settings 114, the automated music generation engine 110 may select, from a plurality of predetermined scenarios 118, a musical development scenario 124. The musical development scenario 124 includes a chronologically ordered sequence of set settings. Based on the selected musical development scenario 124, the automated music generation engine 110 may select, from a plurality of event probability scenarios, an event probability scenario 126 that may define a probability of a music creation event taking place.

The automated music generation engine 110 may further select a plurality of sets of audio elements 128 from a plurality of pre-composed audio elements 120 and audio elements provided in the musical audio input 130 by the user. The pre-composed audio elements 120 may be preliminarily composed by humans. The sets of audio elements 128 may be selected based on the selected musical development scenario 124, the configuration settings 114, the musical audio input 130, the event probability scenario 126, and predetermined music theory rules 122. The automated music generation engine 110 may synthesize the plurality of sets of audio elements 128, which in some example embodiments may include audio elements received in the musical audio input 130, to generate an audio output 116 for providing to the user 102.

The memory unit 112 may store the plurality of predetermined musical development scenarios, the plurality of event probability scenarios, the plurality of pre-composed audio elements, audio elements provided by the user in the musical audio input 130, the predetermined music theory rules, and any other data needed by the automated music generation engine 110 to generate the audio output 116.

Figure 2:
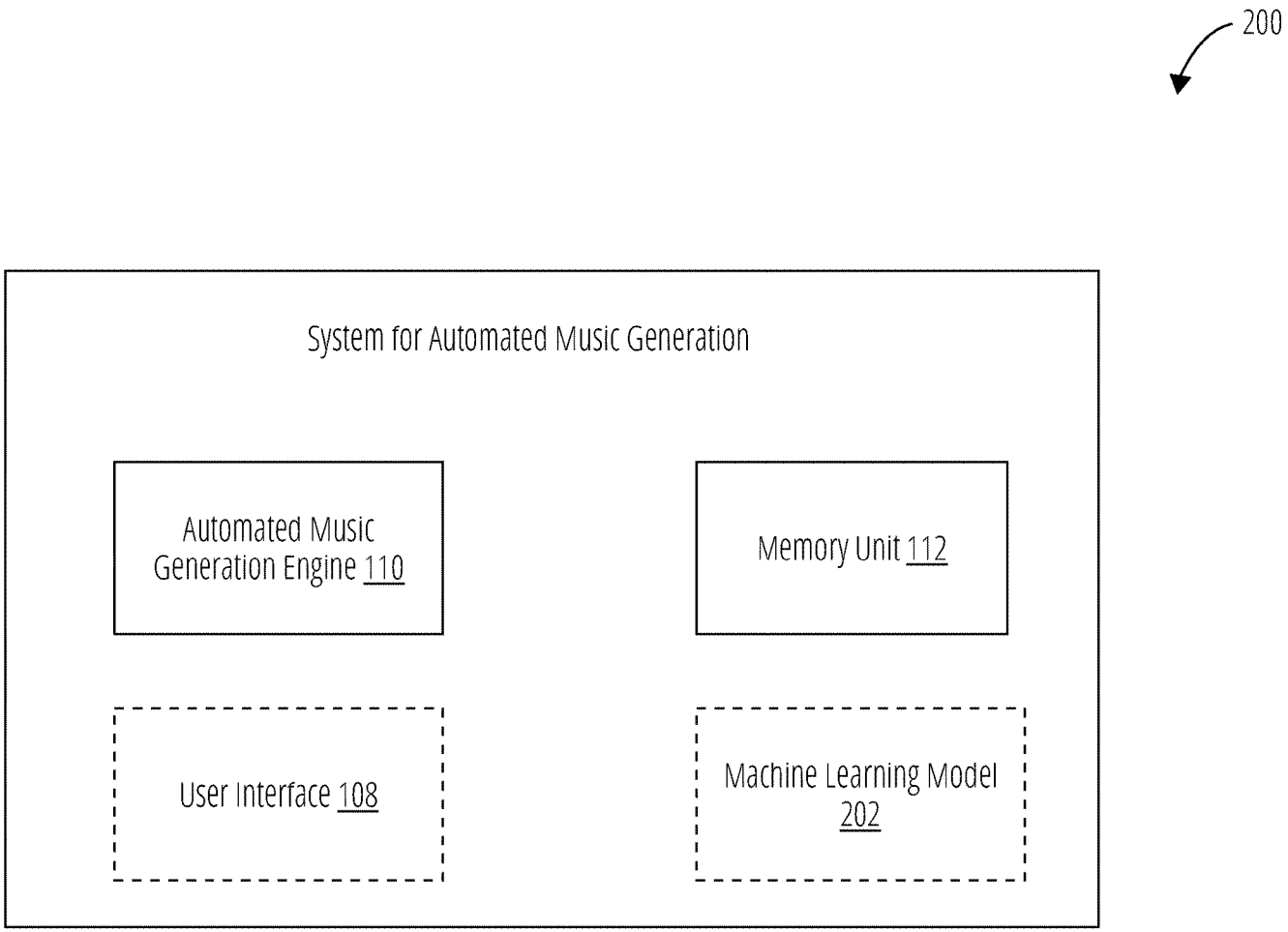
FIG. 2 is a block diagram showing a system for automated music generation, according to an example embodiment.

FIG. 2 is a block diagram showing a structure of a system 200 for automated music generation, according to an example embodiment. The system 200 may include an automated music generation engine 110, a memory unit 112 in communication with the automated music generation engine 110, and optionally a user interface 108 and a machine learning model 202.

The automated music generation engine 110 may be configured to understand basic rules of music theory and how different melodies, chord progressions, and instrument registers can be utilized to create an original track that matches a certain genre, mood, and narrative build. The automated music generation engine 110 may use a predetermined algorithm that draws short, curated, and pre-tagged audio elements or audio building blocks from a library to assemble an original track. The automated music generation engine 110 may also accept, analyze, and tag the musical audio input 130 provided by the user, to include the audio elements of the musical audio input 130 in the assembly of an original track in the audio output.

In an example embodiment, the audio elements and the audio building blocks may be created and curated by humans. The audio elements and the audio building blocks may include modular audio and MIDI elements. MIDI is a technical standard that describes a protocol, digital interface, and file format used in electronic music devices and software applications. The MIDI file format is a standardized format for storing musical information, such as notes, timing, and instrument data. MIDI files do not contain actual sound recordings, but instead contain instructions for electronic instruments or software to play back the music described in the file. A MIDI element typically consists of a series of messages that describe the musical performance, such as note on/off messages, velocity (how hard a note was struck), pitch bend, modulation, and program change messages. These messages are organized in a standardized way to create a musical performance. MIDI elements can also include other data such as lyrics, tempo changes, and markers. MIDI elements can be used to store and exchange musical performances between different software and hardware devices. The MIDI elements can be edited and manipulated using specialized software, allowing musicians and producers to create and modify musical performances with a high degree of precision and control.

The automated music generation engine 110 takes into account the user response to the options that the automated music generation engine 110 generates and utilizes a black box machine learning and generative AI to optimize the track output for positive user response. In the black box machine learning, inputs of the machine learning model and operations performed by the machine learning model are not visible to the user or another interested party. A black box AI model provides conclusions or decisions without any explanations as to how the conclusions or decisions were obtained. A generative AI model may learn patterns and structure of input data and generate output data that have similar patterns and structure.

The user response may include feedback provided to the user in response to listening to the audio output provided by the system 200 to the user. Specifically, the automated music generation engine 110 may be configured to receive, from the user, feedback associated with the audio output generated by the automated music generation engine 110 and provided to the user. Based on the feedback, the automated music generation engine 110 may replace and/or change, by using the machine learning model 202, one or more of the plurality of sets of audio elements of the audio output. Upon replacing and/or changing the one or more of the plurality of sets of audio elements of the audio output, the automated music generation engine 110 may generate a final audio output and provide the final audio output to the user.

The automated music generation engine 110 may use the machine learning model 202, which may learn over time how to make tracks that consistently sound "good" based on signals provided by the user. The signals received from the user may include favoriting a track, adding a track to a playlist, sharing a track, downloading a track, and the like. Similarly, the machine learning model 202 may learn from negative user signals, such as requesting for different options after hearing an initial result without favoriting, saving, sharing, or downloading, and user edits to the track.

The system 200 may further include the user interface 108 for rendering on a client device of the user. Because the music is being stitched together in real time, the user interface 108 offers the user the ability to edit and customize the track on the fly. The user can pick certain aspects of a track that the user likes, such as a melody or chord progression or drums, and replace elements that the user may not like with different melodies/chord progressions/rhythmic patterns and/or replace different instruments with new ones without disrupting the musical cohesion of the final audio output.

The system 200 may enable a user to provide a musical audio input. The system 200 may analyze the musical audio input and include audio elements present in the musical audio input into the plurality of sets of audio elements in the audio output, thereby enabling a user to submit a musical audio input and receive a fully finished, "musically right" high quality music track.

The system 200 may use the machine learning model 202 to generate new audio elements to be included into the plurality of sets of audio elements in the final audio output, by learning from the available audio elements as well as from the musical audio input provided by the user.

The system 200 may change the set settings provided by the user to make the set settings meet the predetermined music theory rules, if needed. Therefore, regardless of what the user changes, the final musical output always sounds "musically right" and cohesive. This feature allows users with no prior musical knowledge to creatively explore the way a track is created by replacing or removing different audio elements while ensuring that the final audio output always follows the predetermined music theory rules such as counterpoint and rhythm matching. Therefore, the final audio output ends up sounding good and connecting emotionally with a human listener every time. Melodies, chord progressions, and drums may be available across different instruments as well. This enables the users to cycle through endless options of music elements, whether it be melodies, chord progressions, bass lines, drums and/or percussion.

The automated music generation engine 110 uses a combination of hard-coded predetermined music theory rules, event probability scenarios, and the machine learning model to operate. Hard-coded predetermined music theory rules set boundaries for the automated music generation engine 110 when it comes to constants in music theory, automatically matching melodies with chord progressions and automatically matching rhythmic patterns. This is accomplished by prescribing certain music theory, counterpoint, rhythm, and arrangement rules that are created specifically for the automated music generation engine 110 and that remain constant in specific music genres and moods.

Event probability scenarios 126 allow the automated music generation engine 110 to compute probabilities based on scenarios and exhibit a certain amount of creative freedom while staying within a framework. The event probability scenarios 126 dictate a set of algorithm parameters or a configuration for certain music creation events taking place when producing an audio track, such as how frequently a new melodic element should be introduced, how often a constant element should be repeated throughout the length of a track, or what the demand for certain scale interval, rhythmic pattern, or chord progression is at the time.

In an example embodiment, the machine learning model 202 may be implemented as a calibration mechanism and may be used to optimize the final audio output for positive user reaction indicators and signals captured through the user interface 108.

The automated music generation engine 110 makes use of expert knowledge to generate musical audio tracks. In particular, the automated music generation engine 110 makes use of musical development scenarios. The musical development scenarios are expert-defined structures that guide the automated music generation engine 110 on how to generate a track to fit the requested musical development or narrative arc.

A musical development scenario is defined as a chronologically ordered sequence of set settings. Each set setting consists of a number of settings. The main settings are flags that specify the registers (musical or audio frequency registers) that are to be played, special effects that are to be applied, whether a new melody is to be used, whether a new chord progression is to be used, if a set of audio elements is a transitional set, and so forth.

There are different musical development scenarios for each predetermined configuration. The configuration may consist of a genre, cue (track) length, mood, and narrative arc, but the configuration can be extended to include additional configurations. There can be multiple scenarios for each configuration.

After the user specifies the genre, duration, mood, and narrative arc of the desired track, the automated music generation engine 110 may sample a single musical development scenario. Afterwards, the automated music generation engine 110 may calculate lengths of individual sets. The calculation depends on the requested tempo as well as the audio elements that are available in a given genre and mood.

The whole process allows the automated music generation engine 110 to tightly fit the narrative arc, while also accounting for variety. The variation in the generated tracks comes from two sources. The first source of variation is the sampling from multiple musical development scenarios defined for each configuration, and the second is the sampling of audio elements once a musical development scenario is determined. The automated music generation engine 110, starting from the set with the largest number of registers or instrument groupings, samples audio elements to be played in each set. The audio element sampling for each set is conditional on that set setting and the cue sampled so far. The sampling function is non-trivial.

Figure 3:
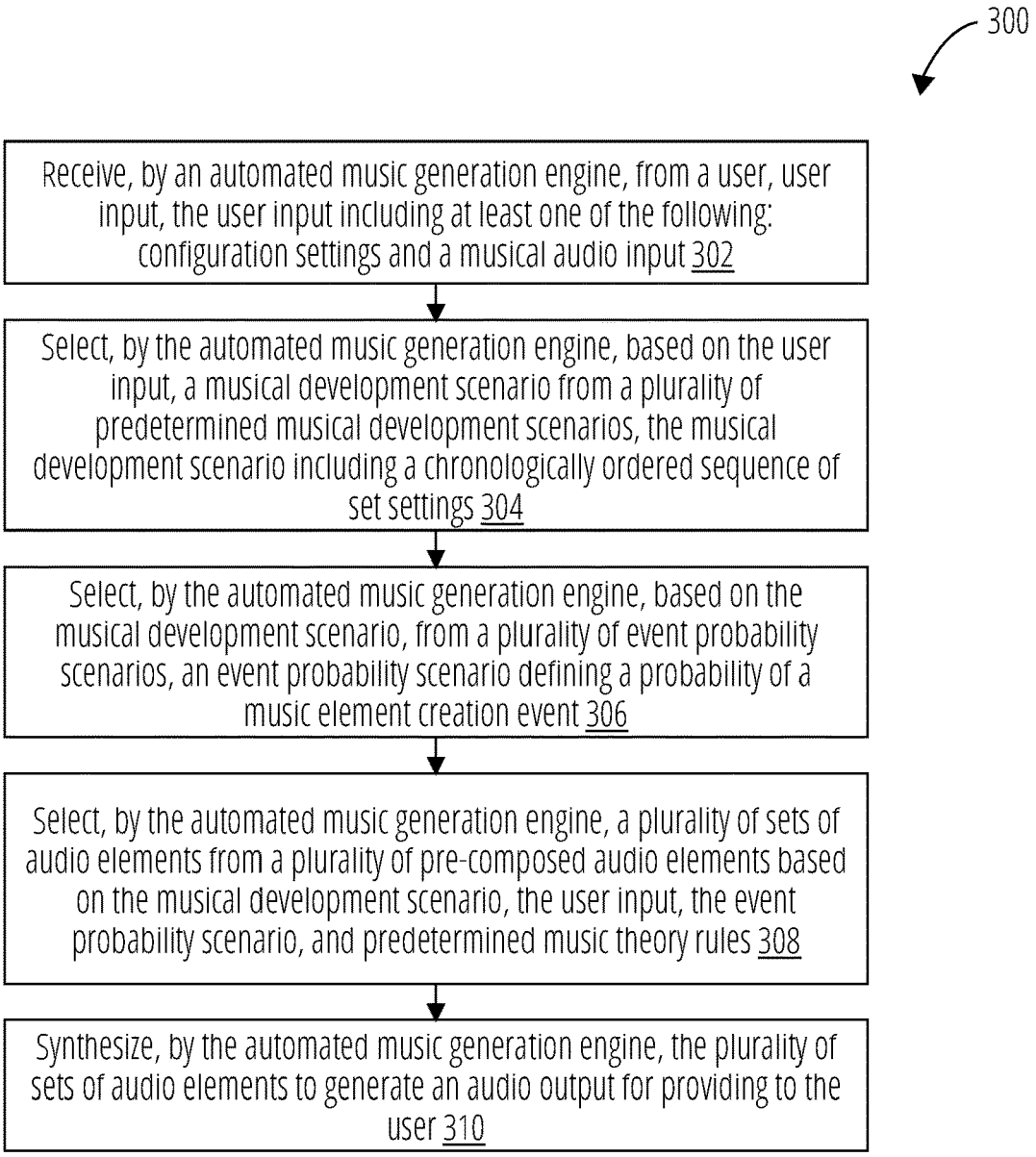
FIG. 3 is a flow diagram illustrating a method for automated music generation, according to an example embodiment.

FIG. 3 is a flow chart of a method 300 for automated music generation, according to one example embodiment. In some embodiments, the operations of the method 300 may be combined, performed in parallel, or performed in a different order. The method 300 may also include additional or fewer operations than those illustrated. The method 300 may be performed by processing logic that may comprise hardware (e.g., decision making logic, dedicated logic, programmable logic, and microcode), software (such as software run on a general-purpose computer system or a dedicated machine), or a combination of both.

The method 300 may commence in block 302 with receiving, by an automated music generation engine, a user input from a user. The user input may include configuration settings and/or a musical audio input. In an example embodiment, the configuration settings may include at least one of a genre, a duration, a mood, a narrative arc, and other settings to be used for generating music desired by the user. The musical audio input may include one or more audio files and audio recordings. The audio files and the audio recordings may consist of audio and MIDI elements. Accordingly, the user is enabled to upload the audio and MIDI elements, which may be used by method 300 for the generation of the audio output.

Upon receiving the user input, the automated music generation engine may select, in block 304, a musical development scenario from a plurality of predetermined musical development scenarios. The musical development scenario may be selected based on the configuration settings and/or the musical audio input. The musical development scenario may include a chronologically ordered sequence of set settings. In an example embodiment, the set settings may include a plurality of settings. The plurality of settings may include one or more of the following: a counterpoint, a rhythm, an arrangement, musical registers to be played, audio frequency registers to be played, special effects to be applied, a melody to be used, a chord progression to be used, selecting a set of audio elements as a transitional set, and so forth. The predetermined music theory rules may prescribe one or more of the plurality of settings to remain constant if a particular configuration setting of the configuration settings is selected.

Upon selection of the musical development scenario, the method 300 may proceed in block 306 with selecting, by the automated music generation engine, an event probability scenario from a plurality of event probability scenarios. The event probability scenario may define a probability of a music element creation event. The event probability scenario may be selected based on the musical development scenario. In an example embodiment, the event probability scenario may define one or more of the following: a frequency of introducing an audio element of the plurality of sets of audio elements in the audio output; a frequency of repeating a constant audio element of the plurality of sets of audio elements throughout a length of the audio output; allowing or disallowing a specific scale interval, a specific rhythmic pattern, and a specific chord progression to be set on demand at a specific time during the audio output; and so forth.

In block 308, the method 300 may include selecting, by the automated music generation engine, a plurality of sets of audio elements from a plurality of pre-composed audio elements. The plurality of sets of audio elements may be selected based on the musical development scenario, the configuration settings and/or the musical audio input, the event probability scenario, and predetermined music theory rules. In an example embodiment, the audio elements received in the musical audio input may be included into the plurality of sets of audio elements and used to derive an audio output.

In block 310, the method 300 may proceed with synthesizing, by the automated music generation engine, the plurality of sets of audio elements to generate the audio output for providing to the user.

In an example embodiment, the method 300 may further include receiving, from the user, feedback associated with the audio output. When the audio output is generated based on the audio elements received in the musical audio input and added into the plurality of sets of audio elements, the feedback may include a feedback associated with the musical audio input synthesized and provided to the user in the audio output. The feedback received from the user may be a positive feedback or a negative feedback. The positive feedback may include one or more of the following: the user favoriting (i.e., adding the track to "favorite tracks" category) a track associated with the audio output, the user adding the track to a playlist, the user sharing the track with other users, the user downloading the track, and so forth. The negative feedback may include receiving, from the user, after providing the audio output to the user, a request for a further version of the audio output. The user may provide the request without performing, by the user, one or more of the following: favoriting the track, saving the track, sharing the track, downloading the track, and so forth.

Based on feedback, the automated music generation engine may modify one or more audio elements of the sets of audio elements. The modifying (i.e., adjustment) may include using a machine learning model to replace, change, or otherwise alter audio elements within the sets of audio elements. In some example embodiments, based on the feedback, the automated music generation engine may generate additional audio elements using the machine learning model. The additional audio elements may be added to the sets of audio elements.

After modifying the audio elements in the sets of audio elements or generating additional audio elements and adding the additional audio elements to the sets of audio elements, the automated music generation engine may create a final audio output for the user. The final audio output may be created from the modified sets of audio elements and may be provided to the user.

The machine learning model utilized by the method 300 may employ sophisticated AI techniques, such as deep learning or other forms of generative AI, often considered "black box" AI due to their complex, non-transparent decision-making processes. This means the machine learning model can generate new audio elements on its own, enhancing the final audio output beyond the use of pre-composed audio elements.

In an example embodiment, the method 300 may further include enabling, by a user interface, the user to customize the generation of the audio output. The customizing may include changing one or more settings of the set settings. Upon receiving the one or more settings changed by the user, the automated music generation engine may determine whether the one or more settings meet the predetermined music theory rules. If the one or more settings changed by the user meet the predetermined music theory rules, the automated music generation engine may generate the audio output based on the changed settings provided by the user. If the one or more settings changed by the user do not meet the predetermined music theory rules, the automated music generation engine may further change the one or more settings to make the one or more settings meet the predetermined music theory rules and, upon changing, use these settings for the generation of the audio output.

Figure 4:
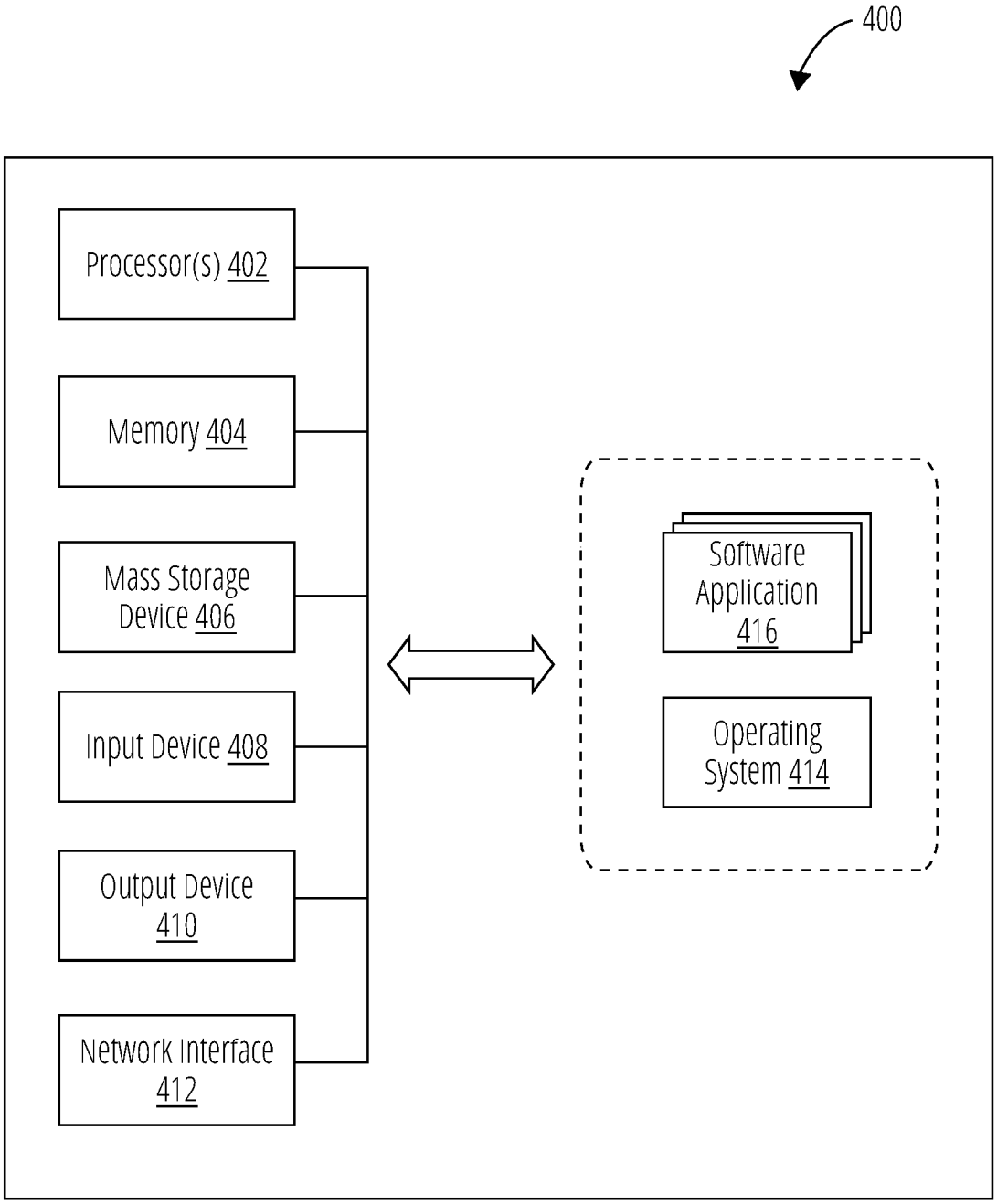
FIG. 4 is a high-level block diagram illustrating an example computer system, within which a set of instructions for causing the machine to perform any one or more of the methodologies discussed herein can be executed.

FIG. 4 is a high-level block diagram illustrating an example computer system 400, within which a set of instructions for causing the machine to perform any one or more of the methodologies discussed herein can be executed. The computer system 400 may include, refer to, or be an integral part of, one or more of a variety of types of devices, such as a general-purpose computer, a desktop computer, a laptop computer, a tablet computer, a netbook, a mobile phone, a smartphone, a personal digital computer, a smart television device, and a server, among others. In some embodiments, the computer system 400 is an example of a client device 104 or a system 200 for automated music generation shown in FIG. 1. Notably, FIG. 4 illustrates just one example of the computer system 400 and, in some embodiments, the computer system 400 may have fewer elements/modules than shown in FIG. 4 or more elements/modules than shown in FIG. 4.

The computer system 400 may include one or more processor(s) 402, a memory 404, one or more mass storage devices 406, one or more input devices 408, one or more output devices 410, and a network interface 412. The processor(s) 402 are, in some examples, configured to implement functionality and/or process instructions for execution within the computer system 400. For example, the processor(s) 402 may process instructions stored in the memory 404 and/or instructions stored on the mass storage devices 406. Such instructions may include components of an operating system 414 or software applications 416. The computer system 400 may also include one or more additional components not shown in FIG. 4.

The memory 404, according to one example, is configured to store information within the computer system 400 during operation. The memory 404, in some example embodiments, may refer to a non-transitory computer-readable storage medium or a computer-readable storage device. In some examples, the memory 404 is a temporary memory, meaning that a primary purpose of the memory 404 may not be long-term storage. The memory 404 may also refer to a volatile memory, meaning that the memory 404 does not maintain stored contents when the memory 404 is not receiving power. Examples of volatile memories include random access memories (RAM), dynamic random access memories (DRAM), static random access memories (SRAM), and other forms of volatile memories known in the art. In some examples, the memory 404 is used to store program instructions for execution by the processor(s) 402. The memory 404, in one example, is used by software (e.g., the operating system 414 or the software applications 416). Generally, the software applications 416 refer to software applications suitable for implementing at least some operations of the methods for automated music generation as described herein.

The mass storage devices 406 may include one or more transitory or non-transitory computer-readable storage media and/or computer-readable storage devices. In some embodiments, the mass storage devices 406 may be configured to store greater amounts of information than the memory 404. The mass storage devices 406 may further be configured for long-term storage of information. In some examples, the mass storage devices 406 include non-volatile storage elements. Examples of such non-volatile storage elements include magnetic hard discs, optical discs, solid-state discs, flash memories, forms of electrically programmable memories (EPROM) or electrically erasable and programmable memories, and other forms of non-volatile memories known in the art.

The input devices 408, in some examples, may be configured to receive input from a user through tactile, audio, video, or biometric channels. Examples of the input devices 408 may include a keyboard, a keypad, a mouse, a trackball, a touchscreen, a touchpad, a microphone, one or more video cameras, image sensors, fingerprint sensors, or any other device capable of detecting an input from a user or other source and relaying the input to the computer system 400, or components thereof.

The output devices 410, in some examples, may be configured to provide output to a user through visual or auditory channels. The output devices 410 may include a video graphics adapter card, a liquid crystal display (LCD) monitor, a light emitting diode (LED) monitor, an organic LED monitor, a sound card, a speaker, a lighting device, a LED, a projector, or any other device capable of generating output that may be intelligible to a user. The output devices 410 may also include a touchscreen, a presence-sensitive display, or other input/output capable displays known in the art.

The network interface 412 of the computer system 400, in some example embodiments, can be utilized to communicate with external devices via one or more data networks such as one or more wired, wireless, or optical networks including, for example, the Internet, intranet, LAN, WAN, cellular phone networks, Bluetooth radio, and an IEEE 902.11-based radio frequency network, Wi-Fi Networks®, among others. The network interface 412 may be a network interface card, such as an Ethernet card, an optical transceiver, a radio frequency transceiver, or any other type of device that can send and receive information.

The operating system 414 may control one or more functionalities of the computer system 400 and/or components thereof. For example, the operating system 414 may interact with the software applications 416 and may facilitate one or more interactions between the software applications 416 and components of the computer system 400. As shown in FIG. 4, the operating system 414 may interact with or be otherwise coupled to the software applications 416 and components thereof. In some embodiments, the software applications 416 may be included in the operating system 414. In these and other examples, virtual modules, firmware, or software may be part of the software applications 416.

Thus, systems and methods for automated music generation have been described. Although embodiments have been described with reference to specific example embodiments, it will be evident that various modifications and changes can be made to these example embodiments without departing from the broader spirit and scope of the present application. Accordingly, the specification and drawings are to be regarded in an illustrative rather than a restrictive sense.

What is claimed is:

1. A system for automated music generation, the system comprising:

an automated music generation engine configured to:

receive, from a user, a user input, the user input including at least one of the following: configuration settings and a musical audio input;

select, based on the user input, a musical development scenario from a plurality of predetermined musical development scenarios, the musical development scenario including a chronologically ordered sequence of set settings;

select, based on the musical development scenario, from a plurality of event probability scenarios, an event probability scenario defining a probability of a music element creation event while generating an audio output, wherein the event probability scenario defines one or more of the following: a frequency of introducing an audio element of a plurality of sets of audio elements in the audio output, a frequency of repeating a constant audio element of the plurality of sets of audio elements throughout a length of the audio output, and allowing or disallowing a specific scale interval, a specific rhythmic pattern, and a specific chord progression to be set on demand at a specific time during the audio output;

based on the event probability scenario, compute probabilities of introducing one or more audio elements of a plurality of pre-composed audio elements into the audio output;

select the plurality of sets of audio elements from the plurality of pre-composed audio elements based on the musical development scenario, the user input, the probabilities computed based on the event probability scenario, and predetermined music theory rules; and synthesize the plurality of sets of audio elements to generate the audio output for providing to the user; and a memory unit in communication with the automated music generation engine, the memory unit storing at least the plurality of predetermined musical development scenarios, the plurality of event probability scenarios, the plurality of pre-composed audio elements, and the predetermined music theory rules.

2. The system of claim 1, wherein the automated music generation engine is further configured to:

receive, from the user, feedback associated with the audio output;

based on the feedback:

modify, by using a machine learning model, one or more of the plurality of sets of audio elements; or generate, by using the machine learning model, one or more further audio elements to be added to the plurality of sets of audio elements; and upon modifying the one or more of the plurality of sets of audio elements or generating the one or more further audio elements, generate, based on the plurality of sets of audio elements, a final audio output for the user.

3. The system of claim 2, wherein the feedback includes one of the following:

a positive feedback, the positive feedback including one or more of the following:

favoriting a track associated with the audio output, adding the track to a playlist, sharing the track, and downloading the track; and a negative feedback, the negative feedback including receiving, from the user, after providing the audio output to the user, a request for a further version of the audio output without performing, by the user, one or more of the following: favoriting the track, saving the track, sharing the track, and downloading the track.

4. The system of claim 2, wherein the machine learning model uses a black box artificial intelligence and generative artificial intelligence.

5. The system of claim 1, wherein the configuration settings include at least one of a genre, a duration, a mood, and a narrative arc; and wherein the musical audio input includes one of one or more audio files and an audio recording.

6. The system of claim 1, further comprising a user interface enabling the user to customize the generation of the audio output, the customizing including changing one or more settings of the set settings.

7. The system of claim 6, wherein the automated music generation engine is further configured to, upon receiving the one or more settings changed by the user, determine whether the one or more settings meet the predetermined music theory rules.

8. The system of claim 1, wherein the set settings include a plurality of settings, the plurality of settings including one or more of the following: a counterpoint, a rhythm, an arrangement, musical registers to be played, audio frequency registers to be played, special effects to be applied, a melody to be used, a chord progression to be used, and selecting a set of audio elements as a transitional set.

9. The system of claim 8, wherein the predetermined music theory rules prescribe one or more of the plurality of settings to remain constant if a configuration setting of the configuration settings is selected.

10. A method for automated music generation, the method comprising:

receiving, by an automated music generation engine, from a user, a user input, the user input including at least one of the following: configuration settings and a musical audio input;

selecting, by the automated music generation engine, based on the user input, a musical development scenario from a plurality of predetermined musical development scenarios, the musical development scenario including a chronologically ordered sequence of set settings;

selecting, by the automated music generation engine, based on the musical development scenario, from a plurality of event probability scenarios, an event probability scenario defining a probability of a music element creation event while generating an audio output, wherein the event probability scenario defines one or more of the following: a frequency of introducing an audio element of a plurality of sets of audio elements in the audio output, a frequency of repeating a constant audio element of the plurality of sets of audio elements throughout a length of the audio output, and allowing or disallowing a specific scale interval, a specific rhythmic pattern, and a specific chord progression to be set on demand at a specific time during the audio output;

based on the event probability scenario, computing, by the automated music generation engine, probabilities of introducing one or more audio elements of a plurality of pre-composed audio elements into the audio output;

selecting, by the automated music generation engine, the plurality of sets of audio elements from the plurality of pre-composed audio elements based on the musical development scenario, the user input, the probabilities computed based on the event probability scenario, and predetermined music theory rules; and synthesizing, by the automated music generation engine, the plurality of sets of audio elements to generate the audio output for providing to the user.

11. The method of claim 10, further comprising:

receiving, from the user, feedback associated with the audio output;

based on the feedback:

modifying, by using a machine learning model, one or more of the plurality of sets of audio elements; or generating, by using the machine learning model, one or more further audio elements to be added to the plurality of sets of audio elements; and upon modifying the one or more of the plurality of sets of audio elements or generating the one or more further audio elements, generating, based on the plurality of sets of audio elements, a final audio output for the user.

12. The method of claim 11, wherein the feedback includes one of the following:

a positive feedback, the positive feedback including one or more of the following: favoriting a track associated with the audio output, adding the track to a playlist, sharing the track, and downloading the track; and a negative feedback, the negative feedback including receiving, from the user, after providing the audio output to the user, a request for a further version of the audio output without performing, by the user, one or more of the following: favoriting the track, saving the track, sharing the track, and downloading the track.

13. The method of claim 10, wherein the configuration settings include at least one of a genre, a duration, a mood, and a narrative arc; and wherein the musical audio input includes one of one or more audio files and an audio recording.

14. The method of claim 10, further comprising enabling, by a user interface, the user to customize the generation of the audio output, the customizing including changing one or more settings of the set settings.

15. The method of claim 14, further comprising, upon receiving the one or more settings changed by the user, determining whether the one or more settings meet the predetermined music theory rules.

16. The method of claim 10, wherein the set settings include a plurality of settings, the plurality of settings including one or more of the following: a counterpoint, a rhythm, an arrangement, musical registers to be played, audio frequency registers to be played, special effects to be applied, a melody to be used, a chord progression to be used, and selecting a set of audio elements as a transitional set.

17. The method of claim 16, wherein the predetermined music theory rules prescribe one or more of the plurality of settings to remain constant if a configuration setting of the configuration settings is selected.

18. A non-transitory computer-readable storage medium, the computer-readable storage medium including instructions that, when executed by a processor, cause the processor to:

receive, from a user, a user input, the user input including at least one of the following: configuration settings and a musical audio input;

select, based on the user input, a musical development scenario from a plurality of predetermined musical development scenarios, the musical development scenario including a chronologically ordered sequence of set settings;

select, based on the musical development scenario, from a plurality of event probability scenarios, an event probability scenario defining a probability of a music element creation event while generating an audio output, wherein the event probability scenario defines one or more of the following: a frequency of introducing an audio element of a plurality of sets of audio elements in the audio output, a frequency of repeating a constant audio element of the plurality of sets of audio elements throughout a length of the audio output, and allowing or disallowing a specific scale interval, a specific rhythmic pattern, and a specific chord progression to be set on demand at a specific time during the audio output;

based on the event probability scenario, compute probabilities of introducing one or more audio elements of a plurality of pre-composed audio elements into the audio output;

select the plurality of sets of audio elements from the plurality of pre-composed audio elements based on the musical development scenario, the user input, the probabilities computed based on the event probability scenario, and predetermined music theory rules; and synthesize the plurality of sets of audio elements to generate the audio output for providing to the user.

* * * * *